US006597237B2

(12) United States Patent
Yoshimura

(10) Patent No.: US 6,597,237 B2
(45) Date of Patent: Jul. 22, 2003

(54) REFERENCE POTENTIAL GENERATOR

(75) Inventor: Masataka Yoshimura, Aichi-ken (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/176,303

(22) Filed: Jun. 20, 2002

(65) Prior Publication Data

US 2002/0196073 A1 Dec. 26, 2002

(30) Foreign Application Priority Data

Jun. 26, 2001 (JP) ..... 2001-192599

(51) Int. Cl.[7] ..... G05F 1/46
(52) U.S. Cl. ..... 327/541; 327/543; 323/313
(58) Field of Search ..... 327/540, 541, 327/543; 323/312, 313

(56) References Cited

U.S. PATENT DOCUMENTS 5,696,440 A * 12/1997 Harada ..... 323/313
5,757,226 A * 5/1998 Yamada et al. ..... 327/543
6,371,179 B1 * 4/2002 Tsuda ..... 327/541

* cited by examiner

*Primary Examiner*—Timothy P. Callahan
*Assistant Examiner*—Terry L. Englund
(74) *Attorney, Agent, or Firm*—Fish & Richardson P.C.

(57) ABSTRACT

A reference potential generator for maintaining a regulated potential even when a power supply potential decreases. When the power supply potential decreases and a potential difference between the power supply potential and a potential at a node of a first circuit becomes lower than a threshold value of an inverter transistor, the inverter transistor is deactivated. This decreases a gate potential of a transistor, which is connected to the inverter transistor, to the ground potential and activates the transistor. In this manner, current is supplied from the power supply potential to a node of a second circuit through the transistor. As a result, the potential (reference potential) at a node of the second circuit increases. This prevents the reference potential from being decreased.

10 Claims, 4 Drawing Sheets

REFERENCE POTENTIAL GENERATOR

BACKGROUND OF THE INVENTION

The present invention relates to a reference potential generator for generating a predetermined reference potential, and more particularly, to a reference potential generator for generating a stable reference potential.

A reference potential generator is configured by a plurality of resistors or transistors that are connected in series between a power supply potential and a ground potential. The resistors or transistors divide the power supply potential and generate the divided potential as a reference potential. Such a reference potential generator is connected to a stage that precedes a control circuit of a voltage controlled oscillator (VCO), and supplies transistors in the control circuit with a constant reference potential. This keeps the operating speed of the control circuit constant.

FIG. 1 is a schematic circuit diagram of a prior art reference potential generator 100. The output terminal of the reference potential generator 100 is connected to the gate of a constant current source n-channel transistor 122 in a control circuit 120. The reference potential generator 100 includes a resistor 1 and a transistor 2, which are connected in series between a power supply potential VDD and a ground potential. The synthetic resistance of the resistance of the resistor 1 and the contact resistance of the transistor 2 divides the power supply potential VDD and generates a reference potential VR. The gate of the transistor 2 is connected to a node A between the resistor 1 and the drain of the transistor 2. The potential VA at node A is output as the reference potential VR.

FIG. 2 is a graph illustrating the relationship between the reference potential VR and the power supply potential VDD. When the power supply potential VDD is applied to the reference potential generator 100, the transistor 2 is activated. This causes current to flow from the power supply potential VDD to the ground potential VGND. As a result, the power supply potential VDD is divided by the contact resistance of the transistor 2 and the resistance of the resistor 1. This generates the reference potential VR, which has a constant potential difference VQ relative to the ground potential VGND. The reference potential VR may be adjusted by the resistance of the resistor 1 and the threshold value of the transistor 2. The reference potential VR controls the activation and deactivation of the n-channel transistor 122. Further, the reference potential VR controls the current flowing between the drain and the source of the activated n-channel transistor 122 at a constant value. That is, the reference potential VR is used as a regulated potential VW of the control circuit 120.

In the above reference potential generator 100, when the power supply potential VDD suddenly decreases due to a battery drain or the influence of noise, the reference potential VR, which is affected by the fluctuation of the power supply potential VDD, decreases. Referring to FIG. 2, for example, when the power supply potential VDD becomes lower than a predetermined potential vm, the reference potential generator 100 cannot maintain the regulated potential VW, which is required by the control circuit 120. This may cause the control circuit 120 to function erroneously.

SUMMARY OF THE INVENTION

It is an object of the present invention to provide a reference potential generator that maintains the regulated potential even when the power supply potential decreases.

To achieve the above object, the present invention provides a reference potential generator for generating a predetermined reference potential. The reference potential generator includes a first circuit including a first resistor and a first transistor connected in series between a first potential and a second potential. The first transistor has a first type of conductivity. The first circuit generates a first reference potential at a first node between the first resistor and the first transistor. An inverter is connected to the first node of the first circuit to generate an output potential that is substantially the same as either the first potential or the second potential in accordance with a potential difference between the first reference potential and the first potential. A second transistor is connected to an output of the inverter and has a second type of conductivity, which is opposite to the first type of conductivity. The second transistor includes a gate electrode, which is connected to the output of the inverter, a source, which is connected to the first potential, and a drain. A second resistor is connected to the drain of the second transistor. A second circuit includes a third resistor and a third transistor connected in series between the first potential and the second potential. The third transistor has the first type of conductivity. The second resistor is connected to a second node between the third resistor and the third transistor. The second circuit generates a second reference potential as the predetermined reference potential at the second node.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
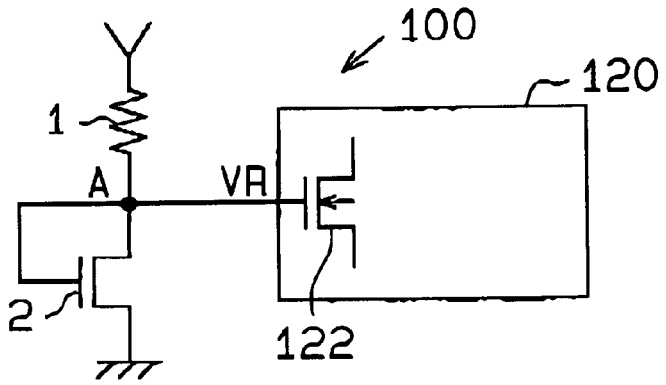
Fig.1 (Prior Art)
FIG. 1 is a schematic circuit diagram of a prior art reference potential generator.
Figure 2:
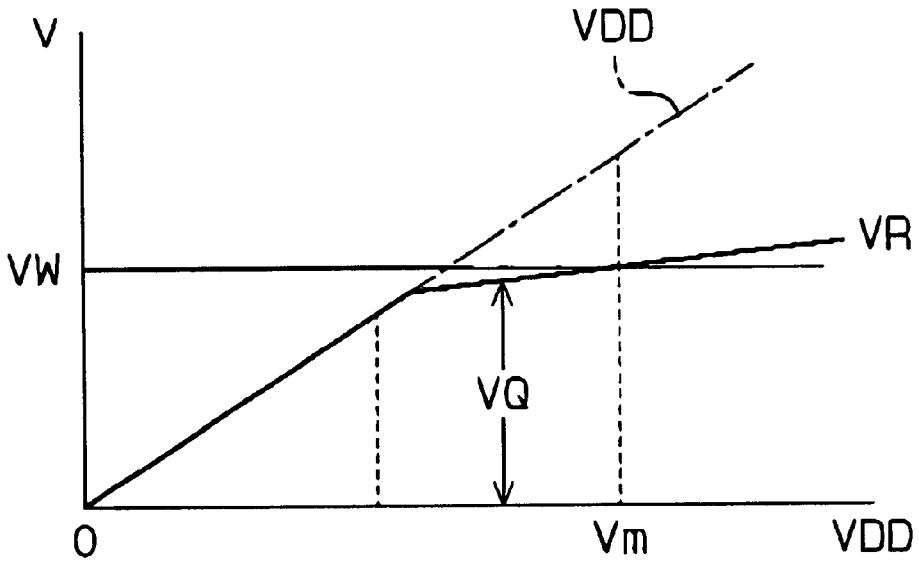
Fig.2 (Prior Art)
FIG. 2 is a graph illustrating the relationship between the reference potential and the power supply potential in the reference potential generator of FIG. 1.

In the drawings, like numerals are used for like elements throughout.

Figure 3:
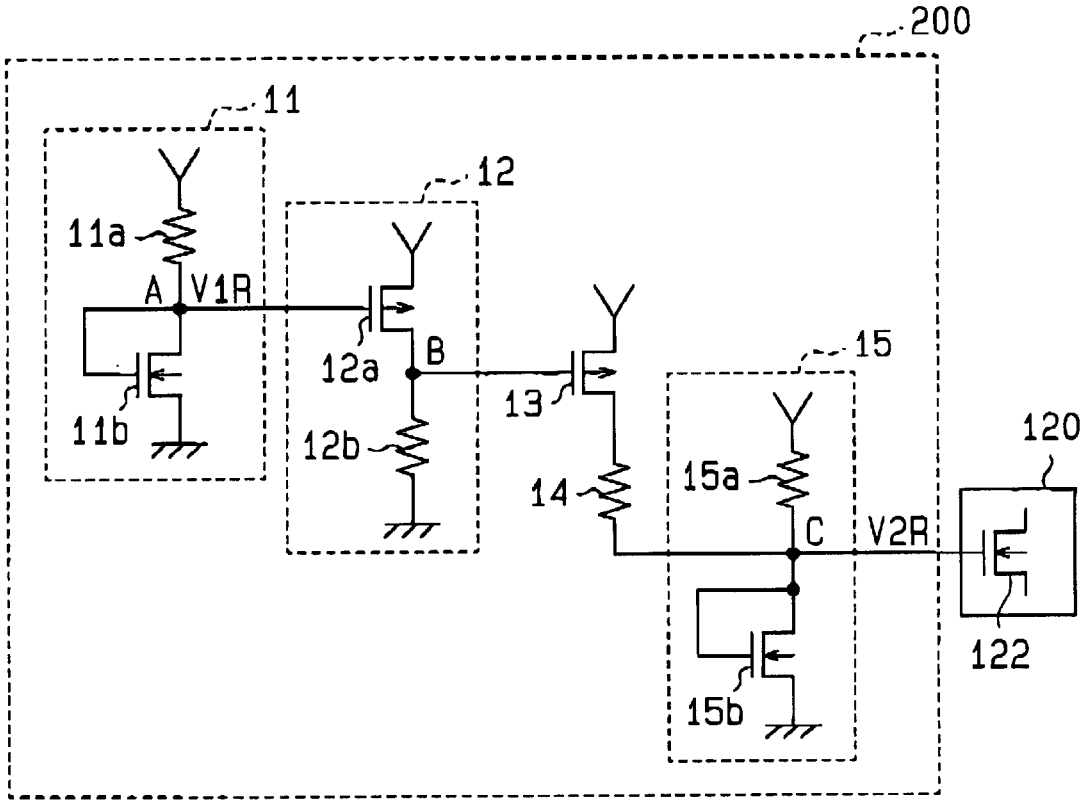
FIG. 3 is a schematic circuit diagram of a reference potential generator according to a first embodiment of the present invention.

FIG. 3 is a schematic circuit diagram of a reference potential generator 200 according to a first embodiment of the present invention. The reference potential generator 200 generates the reference potential and supplies the reference potential to the gate of a constant current source n-channel transistor 122 in a control circuit, which is employed in a voltage controlled oscillator or a sense amplifier. The reference potential generator 200 includes a first circuit 11, an inverter 12, a transistor 13, a resistor 14, and a second circuit 15.

The first circuit 11 includes a resistor 11*a* and a transistor 11*b*, which are connected in series between a power supply potential VDD and a ground potential VGND. When the power supply potential VDD is applied to the reference potential generator 200, the transistor 11*b* is activated. This divides the power supply potential VDD in accordance with the ratio between the resistance of the resistor 11*a* and the ON resistance of the transistor 11*b*. As a result, a first reference potential V1R (potential VA at node A) is generated at node A between the resistor 11*a* and the transistor 11*b*.

The inverter 12 includes a p-channel transistor 12*a* and a resistor 12*b*, which are connected in series between the power supply potential VDD and the ground potential VGND. In the first embodiment, the resistance of the resistor 12*b* is significantly greater than the ON resistance of the transistor 12*a*. The first circuit 11 applies the first reference potential V1R (potential VA) to the gate of the transistor 12*a* in the inverter 12. The transistor 12*a* functions in accordance with the potential difference between the first reference potential V1R and the power supply potential VDD. Further, the power supply potential VDD or the ground potential VGND is output from node B between the transistor 12*a* and the resistor 12*b*. A threshold value voltage V1P of the transistor 12*a* is set so that the transistor 12*a* is activated when the power supply potential VDD is sufficiently high.

The transistor 13, which is a p-channel transistor, has a gate connected to node B (output of the inverter 12), a source connected to the power supply potential VDD, and a drain connected to the resistor 14. The transistor 13 functions as a switching device that selectively opens a current supply route extending from the power supply potential VDD to the resistor 14. The output potential of the inverter 12 controls the switching between the opening and closing of the current supply route. The resistor 14 has a first terminal, which is connected to the drain of the transistor 13, and a second terminal, which is connected to the second circuit 15 (node C).

The second circuit 15 includes a resistor 15*a* and an n-channel transistor 15*b*, which are connected in series between the power supply potential VDD and the ground potential VGND. The second circuit 15 generates a reference potential at node C between the resistor 15*a* and the transistor 15*b*. The second terminal of the resistor 14 is connected to node C. When the transistor 13 is deactivated, the current supply route extending between the power supply potential VDD and node C is opened. Thus, the reference potential V2R is determined by the synthetic resistance of the resistance of the resistor 15*a* and the ON resistance of the n-channel transistor 15*b*. When the transistor 13 is activated, current is supplied to node C through the transistor 13. This generates a third reference potential V'2R, which is greater than the reference potential V2R.

Figure 4:
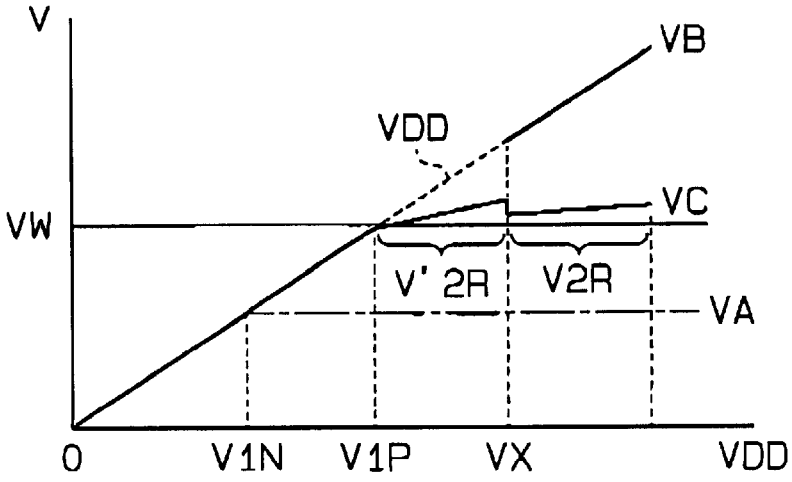
FIG. 4 is a graph illustrating the relationship between the potential at each node and the power supply potential in the reference potential generator of FIG. 3.

The operation of the reference potential generator 200 will now be discussed with reference to FIG. 4. FIG. 4 illustrates the fluctuation of the power supply potential VDD in associated with potentials VA, VB, VC at each node. The threshold voltage values of the transistors 11*b*, 12*a*, 13, and 15*b* are represented by V1N, V1P, V2P, and V2N, respectively.

When the power supply potential VDD is sufficiently high and the power supply potential VDD is applied to the reference potential generator 200, the transistor 11*b* of the first circuit 11 is activated, the route extending from the power supply potential VDD to the ground potential VGND is closed, and the potential VA at node A increases. Since the power supply potential VDD is sufficiently high and stable, the potential VA at node A is stable. The potential VA is applied to the inverter 12 as the first reference potential V1R. The threshold value V1P of the transistor 12*a* is less than the potential difference between the first reference potential V1R and the power supply potential VDD. Thus, the transistor 12*a* is activated, the potential VB at node B goes high, and the power supply potential VDD is applied to the gate of the transistor 13. In this state, the power supply potential VDD is applied to the source of the transistor 13. Thus, the transistor 13 remains deactivated, and the current supply route extending from the power supply potential VDD to node C is opened. Accordingly, the potential VC at node C is determined by dividing the power supply potential VDD with the resistor 15*a* and the transistor 15*b*. This generates a stable potential, or the second reference potential V2R. The second reference potential V2R is supplied to the control circuit 120 as the output potential of the reference potential generator 200. In this state, the potential difference between the second reference potential V2R and the ground potential VGND is substantially constant and stable.

For example, when the battery drains or when noise is mixed in the power supply circuit, the power supply potential VDD may suddenly decrease. When the power supply potential VDD decreases (VDD<VX) before the potential difference between the power supply potential VDD and the first reference potential V1R (potential VA) becomes lower than the threshold value V1P of the p-channel transistor 12*a*, the p-channel transistor 12*a* is deactivated. In this manner, the potential VB at node B is decreased to substantially to the ground potential to activate the transistor 13. This closes the route extending from the power supply potential VDD to node C and supplies the second circuit 15 with current. As a result, the second reference potential V2R goes high and generates the third reference potential V'2R, which is higher than the regulated potential VW. The third reference potential V'2R is maintained until the potential difference between the power supply potential VDD and the ground potential VGND becomes smaller than the threshold voltage V2P of the transistor 13. Accordingly, the n-channel transistor 122 of the control circuit 120 remains conductive and erroneous functioning is prevented.

Figure 5:
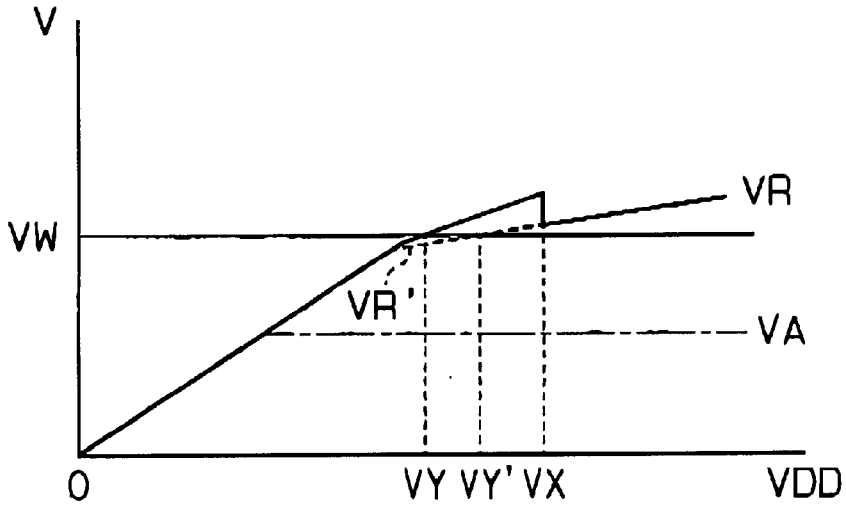
FIG. 5 is a graph illustrating the relationship between the reference potential, which is generated by the reference potential generator of FIG. 3 and by the prior art reference potential generator, and the power supply potential.

The prior art reference potential generator 100 and the reference potential generator 200 of the present invention are compared in FIG. 5. FIG. 5 is a graph illustrating the relationship between the reference potential and the power supply potential VDD. In FIG. 5, VR denotes the reference potential of the first embodiment, and VR' denotes the reference potential of the prior art. As shown in FIG. 5, the reference potential generator 100 of the prior art generates the reference potential VR' that is greater than or equal to the regulated potential VW when the power supply potential VDD exceeds potential VY' (i.e., the intersecting point of the regulated potential VW and the reference potential VR') (VDD>VY'), the generated reference potential VR' is greater than or equal to the regulated potential VW. That is, the minimum potential Vm' of the power supply potential VDD that is required to generate the reference potential VR', which is greater than or equal to the regulated potential VW, is Vm'=VY'.

In the first embodiment, when the power supply potential VDD exceeds potential VY (i.e., the intersecting point of the regulated potential VW and the reference potential VR) (VDD>VY), the generated reference potential VR is greater than or equal to the regulated potential VW. That is, the minimum value Vm of the power supply potential VDD that is required to generate the reference potential VR, which is greater than or equal to the regulated potential VW, is potential VY, which is lower than potential VY' (Vm'). Accordingly, in comparison with the prior art reference potential generator 100, the reference potential generator 200 compensates for the regulated potential VW within a wide range.

Figure 6:
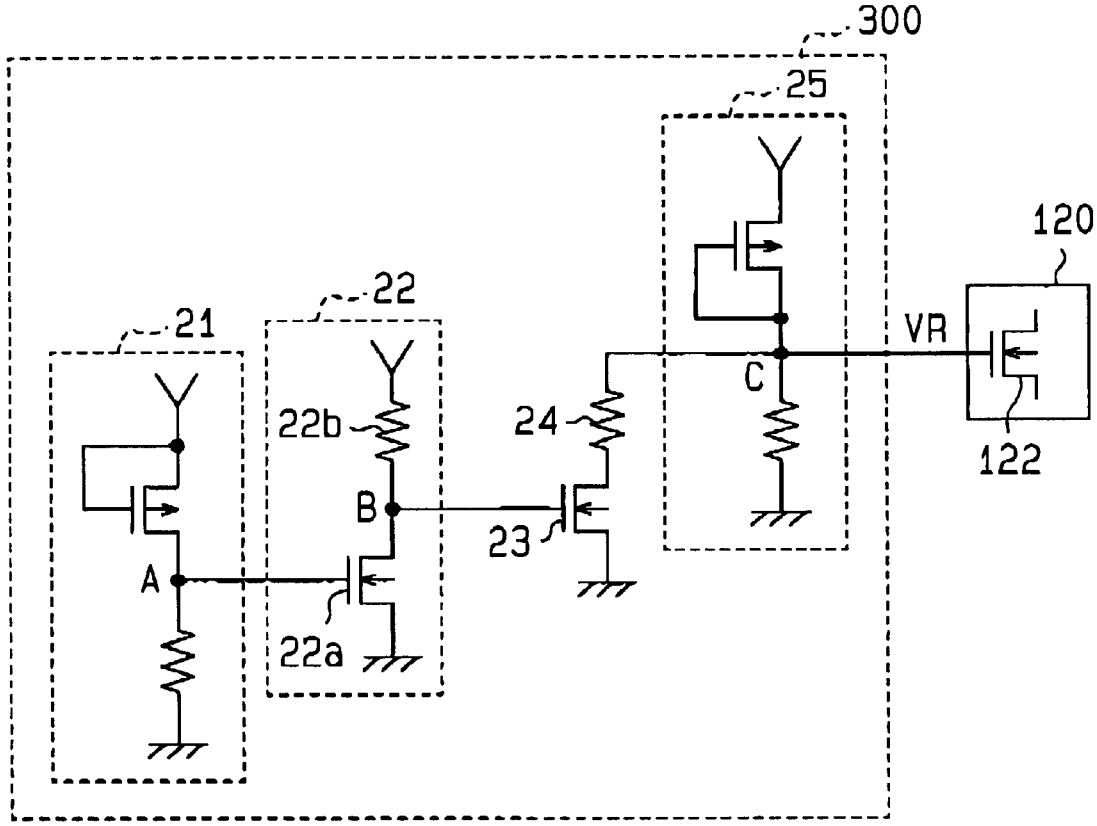
FIG. 6 is a circuit diagram of a reference potential generator according to a second embodiment of the present invention.
Figure 7:
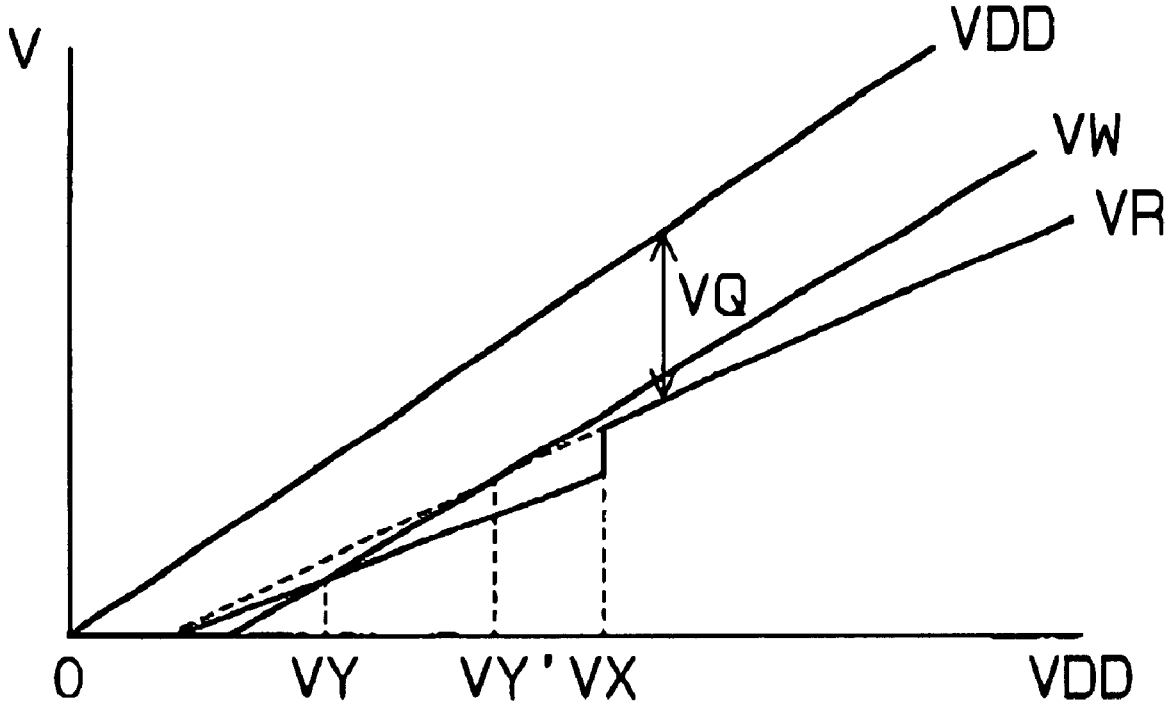
FIG. 7 is a graph illustrating the relationship between the reference potential generated by the reference potential generator of FIG. 6 and the power supply potential.

A reference potential generator 300 according to a second embodiment of the present invention will now be discussed. FIG. 6 is a schematic circuit diagram of the reference potential generator 300 of the second embodiment, and FIG. 7 is a graph illustrating the relationship between the reference potential VR and the power supply potential VDD. The reference potential generator 300, which is connected to the gate of an n-channel transistor 122 in a control circuit 120, applies the reference potential VR to the gate. The reference potential generator 300 includes a first circuit 21, an inverter 22, a transistor 23, a resistor 24, and a second circuit 25. In the second embodiment, p-channel transistors are used in lieu of the n-channel transistors of the first embodiment.

In the second embodiment, when the power supply potential VDD is applied to the reference potential generator 300, the reference potential VR in which the potential difference VQ between the reference potential VR and the power supply potential VDD is substantially constant is generated. When the power supply potential VDD suddenly decreases, the potential VA at node A decreases. This deactivates the transistor 22*a*, causes the potential VB at node B to go high, and activates the transistor 23. In this manner, the reference potential VR goes low, and the potential difference VQ between the power supply potential VDD and the reference potential VR widens. Thus, the regulated potential VW is compensated for even if the power supply potential decreases to VY (the intersecting point of the regulated potential and the reference potential VR).

It should be apparent to those skilled in the art that the present invention may be embodied in many other specific forms without departing from the spirit or scope of the invention. Particularly, it should be understood that the present invention may be embodied in the following forms.

What is claimed is:

1. A reference potential generator for generating a predetermined reference potential, the reference potential generator comprising:

a first circuit including a first resistor and a first transistor connected in series between a first potential and a second potential, the first transistor having a first type of conductivity, wherein the first circuit generates a first reference potential at a first node between the first resistor and the first transistor;

an inverter connected to the first node of the first circuit to generate an output potential that is substantially the same as either the first potential or the second potential in accordance with a potential difference between the first reference potential and the first potential;

a second transistor connected to an output of the inverter and having a second type of conductivity, which is opposite to the first type of conductivity, wherein the second transistor has a gate electrode, which is connected to the output of the inverter, a source, which is connected to the first potential, and a drain;

a second resistor connected to the drain of the second transistor; and a second circuit including a third resistor and a third transistor connected in series between the first potential and the second potential, the third transistor having the first type of conductivity, wherein the second resistor is connected to a second node between the third resistor and the third transistor, and wherein the second circuit generates a second reference potential as the predetermined reference potential at the second node.

2. The reference potential generator according to claim 1, wherein the inverter includes a fourth resistor and a fourth transistor connected in series between the first potential and the second potential, the fourth transistor having the second type of conductivity, wherein the fourth transistor has a gate electrode connected to the first node of the first circuit, and wherein the gate electrode of the second transistor is connected to a third node between the fourth resistor and the fourth transistor.

3. The reference potential generator according to claim 2, wherein the first potential is a power supply potential, and the second potential is a ground potential.

4. The reference potential generator according to claim 3, wherein the first type of conductivity is n-type, and the second type of conductivity is p-type.

5. The reference potential generator according to claim 2, wherein the first potential is a ground potential, and the second potential is a power supply potential.

6. The reference potential generator according to claim 5, wherein the first type of conductivity is p-type, and the second type of conductivity is n-type.

7. The reference potential generator according to claim 1, wherein the first potential is a power supply potential, and the second potential is a ground potential.

8. The reference potential generator according to claim 7, wherein the first type of conductivity is n-type, and the second type of conductivity is p-type.

9. The reference potential generator according to claim 1, wherein the first potential is a ground potential, and the second potential is a power supply potential.

10. The reference potential generator according to claim 9, wherein the first type of conductivity is p-type, and the second type of conductivity is n-type.

* * * * *